United States Patent [19]

Roth

[11] 4,089,338

[45] May 16, 1978

[54] CIGARETTE FLICKER

[76] Inventor: Peter C. Roth, 790 Harem Ave., Opa Locka, Fla. 33054

[21] Appl. No.: 732,087

[22] Filed: Oct. 13, 1976

[51] Int. Cl.[2] ..... A24F 13/20

[52] U.S. Cl. ..... 131/237; 30/113

[58] Field of Search ..... 131/233, 235 R, 237, 131/250, 256; 431/144; 30/109, 111, 113

[56] References Cited

U.S. PATENT DOCUMENTS

| | | | |
|---|---|---|---|
| 863,123 | 8/1907 | Weinbrecht | 30/113 |
| 964,561 | 7/1910 | Salviolo | 30/109 |
| 1,166,881 | 1/1916 | Anderson | 30/113 |
| 1,336,724 | 4/1920 | Berberich | 30/113 |
| 2,694,400 | 11/1954 | Brock | 131/237 |
| 2,740,410 | 4/1956 | Harris | 131/237 |
| 3,477,444 | 11/1969 | Adams | 131/237 |
| 4,027,682 | 6/1977 | Halmaghi | 131/237 |

FOREIGN PATENT DOCUMENTS

| | | | |
|---|---|---|---|
| 780 of | 1914 | United Kingdom | 30/113 |

*Primary Examiner*—Carroll B. Dority, Jr.
*Attorney, Agent, or Firm*—Robert D. Farkas

[57] ABSTRACT

A combination ash tray and sliding member disposed thereacross that is adapted to engage the lighted end of a cigarette and remove the burning edge therefrom.

7 Claims, 3 Drawing Figures

CIGARETTE FLICKER

BACKGROUND OF THE INVENTION

This invention relates to a device for use in combination with an ash tray for removing the lighted end of a cigarette. More particularly, the invention relates to a device that is adjustable for fit and rests across the width of an ash tray and contains a slide member to knock the lighted edge off of the cigarette or cigar.

SUMMARY OF THE INVENTION

It is accordingly an object of the instant invention to provide for a new and improved device for removing the lighted end from a cigarette or cigar.

It is another object to provide for the same having the attributes as aforedescribed.

It is a further object to provide for the same at relatively little cost thereby making it generally available.

These and other objects and advantages of the invention will become more apparent from a consideration of the following detailed disclosure and claims and and by reference to the accompanying drawings, in which:

Figure 1:
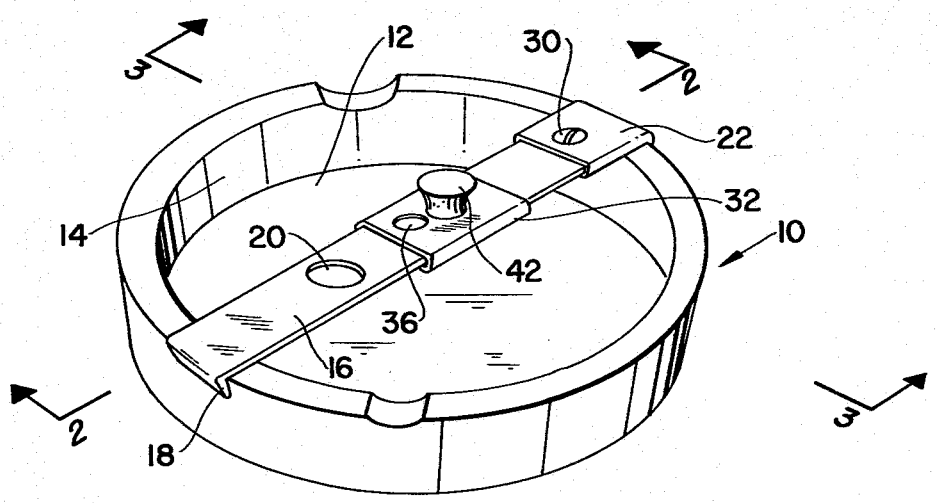
FIG. 1 is a plan view of one embodiment of the invention.
Figure 2:
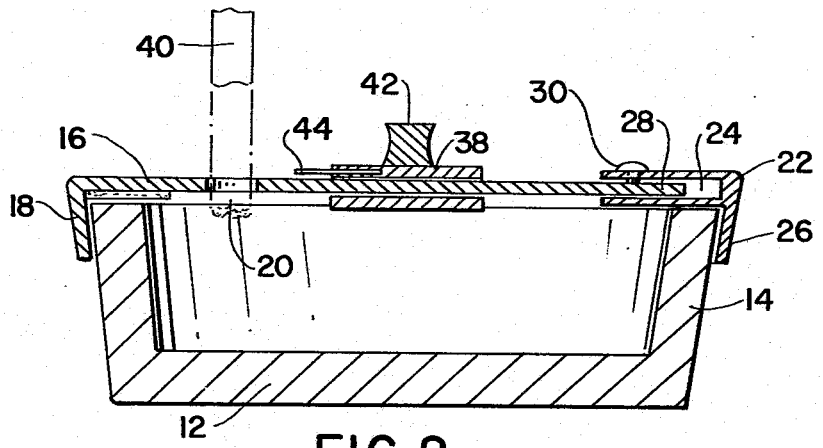
FIG. 2 is a side elevational view partly in section of a second embodiment.
Figure 3:
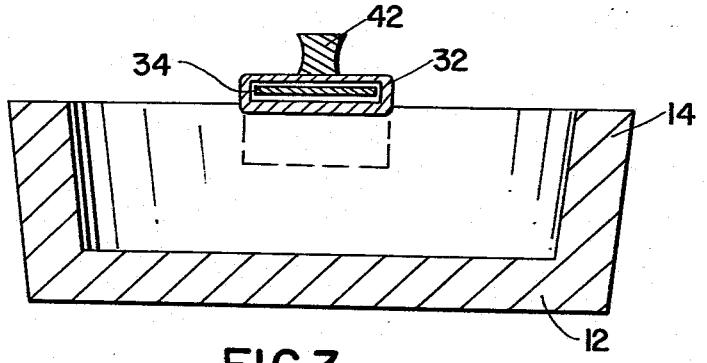
FIG. 3 is a sectional view taken along the line 3—3 of FIG. 1.

Broadly speaking, the instant invention includes the provision of an appliance for use in combination with a cigarette or cigar for removing the lighted end thereof, comprising a generally flat member having at least one downwardly turned flange portion at one end thereof, the member defining a front aperture therein for receiving a cigarette or cigar, a second member having a substantially centrally disposed recess of a predetermined internal diameter larger than the external diameter of the first member and adapted to slide thereacross, the second member including means thereon for contacting the cigarette or cigar and removing the lighted end therefrom.

DETAILED DISCLOSURE

Referring more particularly to the drawings, there is shown a conventional ash tray 10 that includes a base portion 12 and a wall 14 therearound. The instant device includes a generally flat member 16 having one end portion including a flange 18 bent at an angle of less than about 90°, i.e. about 75°–45°. The flange is adapted to engage the wall 14 of the ash tray 10 and then stabilize the disposition of device which lies thereacross, horizontally across the open top thereof. The member 18 will define an aperture 20 adjacent the end carrying the flange 18. The opposite end of the member 16 may if desired, also contain a flange, however, in the preferred embodiment a member 22 having an internal cavity 24 and an open end commumicating therewith and a similar flange 24 at the opposite end receives the end 28 of the member 18 in telescopic fashion. The cavity or recess 24 having a predetermined internal diameter larger than the external diameter of the member 14, both of which are generally rectangular in cross section. The member 22 can be adjusted for fit on the member 16 frictionally and may if desired, contain a set screw or like means 30 thereon to engage one surface of the member 16. A third member 32 having approximately the same dimension as member 22 but without the flange 26, is open at both ends and slides across the member 16 from one end thereof to the other, the member 16 mating with the central cavity 34 thereof. An aperture 36 may be defined through one portion thereof (i.e. top wall 38) and is in axial alignment with front aperture 20 when the member 32 is slid thereacross such that a cigarette or cigar 40 when placed therein is snuffed out by the member 32 moving across member 16 with the cigarette 40 placed in the aligned apertures 20, 36; a handle means 42 may be disposed across the top 38 of the member 32 to facilitate the movement thereof. In another embodiment, a knife blade 44 may be disposed on the top portion 38 of member 32 to cut across the cigarette instead of merely knocking the lighted edge off. The blade 44 may be disposed in a recess in the portion 38 or be attached thereto.

Since it is obvious that numerous changes and modifications can be made in the above-described details without departing from the spirit and nature of the invention, it is to be understood that all such changes and modifications are included within the scope of the invention.

I claim:

1. An appliance for use in combination with a cigarette or cigar for removing the lighted end thereof, comprising a generally flat first member having at least one downwardly turned flange portion at one end thereof, said first member defining a first aperture therein for receiving a cigarette or cigar, said first member having a pre-determined external diameter, a second member, said second member having a substantially centrally disposed recess of a pre-determined internal diameter larger than said external diameter of said first member and adapted to slide thereacross, a third member having at least one open end, a central cavity therein communicating with said open end, said cavity having an internal diameter greater than said external diameter and a downwardly turned flange at the opposite end thereof, said third member adapted to telescopically engage said first member, said second member including means thereon for contacting said cigarette or cigar and removing the lighted end therefrom.

2. The appliance as defined in claim 1, wherein said means is a second aperture adapted to be axially aligned with said first aperture and adapted to receive said cigarette or cigar therein when axially aligned.

3. The appliance as defined in claim 1, wherein said second member includes handle means.

4. The appliance as defined in claim 1, wherein said means is a blade protruding from and disposed on said second member.

5. The appliance as defined in claim 4, wherein said blade is substantially parallel to said first member.

6. The appliance as defined in claim 1, further comprising means for securing said third member to said first member.

7. The appliance as defined in claim 1 in combination with an ash tray having a base portio, wall portion and open top.

* * * * *